US008733409B2

(12) United States Patent
Reid

(10) Patent No.: US 8,733,409 B2
(45) Date of Patent: May 27, 2014

(54) PROCESS TO MANUFACTURE FRAME USING RENEWABLE WOOD PRODUCT(S)

(75) Inventor: Griff Reid, Sacramento, CA (US)

(73) Assignee: Composite Technology International Inc., Sacramento, CA (US)

( * ) Notice: Subject to any disclaimer, the term of this patent is extended or adjusted under 35 U.S.C. 154(b) by 585 days.

(21) Appl. No.: 12/907,938

(22) Filed: Oct. 19, 2010

(65) Prior Publication Data

US 2012/0090735 A1 Apr. 19, 2012

(51) Int. Cl.
*B27J 7/00* (2006.01)

(52) U.S. Cl.
USPC ..... 144/333; 144/348; 144/364; 144/369; 144/380

(58) Field of Classification Search
USPC ..... 144/329, 330, 333, 347, 348, 352, 354, 144/359, 363, 364, 366, 367, 369, 380
See application file for complete search history.

(56) References Cited

U.S. PATENT DOCUMENTS

| | | | | |
|---|---|---|---|---|
| 1,566,863 | A | 12/1925 | Harrison | |
| 1,879,005 | A | 9/1932 | Andersen | |
| 2,317,635 | A | 4/1943 | Olsen | |
| 3,591,985 | A | 7/1971 | Coppins | |
| 3,815,285 | A | 6/1974 | Kuyper | |
| 3,968,614 | A | 7/1976 | Wallace | |
| 3,985,169 | A * | 10/1976 | Chow | 144/347 |
| 4,325,993 | A * | 4/1982 | Schroder | 427/315 |
| 4,402,170 | A | 9/1983 | Seidner | |
| 4,791,771 | A | 12/1988 | Haugaard et al. | |
| 4,979,346 | A | 12/1990 | Pollard | |
| 5,072,547 | A | 12/1991 | DiFazio | |
| 5,115,597 | A | 5/1992 | Tillery et al. | |
| 5,212,921 | A | 5/1993 | Unruh | |
| 5,448,869 | A | 9/1995 | Unruh et al. | |
| 5,546,715 | A | 8/1996 | Edstrom | |
| 5,569,713 | A | 10/1996 | Lieberman | |
| 5,603,585 | A | 2/1997 | Bruchu et al. | |
| 5,634,306 | A | 6/1997 | Riegelman | |
| 5,651,223 | A | 7/1997 | Novak et al. | |
| 5,661,943 | A | 9/1997 | Hagel | |
| 5,687,518 | A | 11/1997 | Endo et al. | |
| 5,758,458 | A | 6/1998 | Ridge | |
| 5,873,209 | A | 2/1999 | Hagel | |
| 5,901,510 | A | 5/1999 | Ellingson | |

(Continued)

FOREIGN PATENT DOCUMENTS

EP 1844681 A1 * 10/2007 ..... A47B 13/04

OTHER PUBLICATIONS

U.S. Appl. No. 60/887,256, filed Jan. 30, 2007, Titled "Door Frame Having Durable Wood Portions,", 7 pages.

(Continued)

*Primary Examiner* — Bena Miller
(74) *Attorney, Agent, or Firm* — Berkeley Law & Technology Group, LLP

(57) ABSTRACT

A method of processing bamboo to produce bamboo composite blocks for use in a wood frame. The method includes forming rectangular bamboo stickers, wherein a rectangular bamboo sticker comprises of consistent dimensions as to at least one other of the rectangular bamboo stickers, steaming the rectangular bamboo stickers, kiln drying the rectangular bamboo stickers, and acclimatizing the rectangular bamboo stickers. The method also includes assembling the rectangular bamboo stickers to form bamboo composite blocks, and hot pressing the bamboo composite blocks.

10 Claims, 3 Drawing Sheets

101
104
105
106
105
105
106
105
106
105
106

(56) References Cited

U.S. PATENT DOCUMENTS

| | | | | |
|---|---|---|---|---|
| 5,932,353 | A | 8/1999 | Huarng et al. | |
| 6,122,882 | A | 9/2000 | Hagel | |
| 6,218,023 | B1 | 4/2001 | Denicola et al. | |
| 6,282,851 | B1 | 9/2001 | Beaton | |
| 6,430,889 | B1 | 8/2002 | Nixon, Sr. | |
| 6,446,410 | B1 | 9/2002 | Hagel | |
| 6,604,334 | B2 | 8/2003 | Rochman | |
| 6,670,039 | B1 * | 12/2003 | Nagle et al. | 428/408 |
| 6,824,851 | B1 | 11/2004 | Locher et al. | |
| 7,059,092 | B2 | 6/2006 | Harkins et al. | |
| 7,487,591 | B2 | 2/2009 | Harkins et al. | |
| 7,981,233 | B2 * | 7/2011 | Wellwood et al. | 156/182 |
| 2002/0046532 | A1 | 4/2002 | Rochman | |
| 2002/0069604 | A1 | 6/2002 | Canfield | |
| 2003/0037507 | A1 | 2/2003 | Weza | |
| 2004/0206022 | A1 | 10/2004 | Panto | |
| 2005/0193652 | A1 | 9/2005 | Cornell | |
| 2005/0281999 | A1 | 12/2005 | Hofmann et al. | |
| 2006/0165954 | A1 * | 7/2006 | Gold | 428/105 |
| 2006/0175762 | A1 | 8/2006 | Barnett et al. | |
| 2007/0056655 | A1 * | 3/2007 | Vinden | 144/380 |
| 2007/0204534 | A1 | 9/2007 | Lin et al. | |
| 2008/0110565 | A1 * | 5/2008 | Parker | 156/296 |
| 2008/0145605 | A1 * | 6/2008 | Gold | 428/124 |
| 2008/0261036 | A1 * | 10/2008 | Wu | 428/337 |
| 2008/0280092 | A1 * | 11/2008 | Gold | 428/81 |
| 2009/0162600 | A1 * | 6/2009 | Gold | 428/76 |
| 2010/0285295 | A1 * | 11/2010 | Wang et al. | 428/292.4 |
| 2010/0295334 | A1 * | 11/2010 | Chorney et al. | 296/184.1 |
| 2011/0027529 | A1 * | 2/2011 | Zhang et al. | 428/137 |
| 2011/0183136 | A1 * | 7/2011 | Gold | 428/223 |
| 2011/0262727 | A1 * | 10/2011 | Tu et al. | 428/215 |
| 2012/0076975 | A1 * | 3/2012 | Parker | 428/114 |

OTHER PUBLICATIONS

U.S. Appl. No. 12/022,418, filed Jan. 30, 2008, Titled "Door Frame Having Durable Wood Portions,", 14 pages.
U.S. Appl. No. 11/506,377, filed Aug. 18, 2006, Titled "Composite Frame for an Opening,", 29 pages.
Exterior Paint: Choosing the Right Paint, Jun. 4, 2003, Painting Your House, Last visited on Feb. 10, 2011 via Way Back Machine URL: http://web.archive.org/web/20030604071129/http://paintingyourhouse.info/exterior_paint.htm.
U.S. Appl. No. 60/710,037: Provisional application as filed on Aug. 19, 2005.
U.S. Appl. No. 60/710,037: Notice to File Missing Parts, mailed Aug. 31, 2005, 2 pages.
U.S. Appl. No. 60/710,037: Notice to File Missing Parts Response, mailed Jan. 11, 2006, 8 pages.
U.S. Appl. No. 11/506,377: Application and Nonpublication Request as filed on Aug. 18, 2006, 34 pages.
U.S. Appl. No. 11/506,377: Notice to File Missing Parts, mailed Sep. 6, 2006, 2 pages.
U.S. Appl. No. 11/506,377: Notice to File Missing Parts Response, mailed, Dec. 6, 2006, 12 pages.
U.S. Appl. No. 11/506,377: Filing Receipt, mailed Dec. 15, 2006, 4 pages.
U.S. Appl. No. 11/506,377: Rescind Nonpublication Request for Pre Grant Pub, mailed Mar. 6, 2007, 4 pages.
U.S. Appl. No. 11/506,377: Notice of New or Revised Publication Date, mailed Mar. 15, 2007, 1 Page.
U.S. Appl. No. 11/506,377: Notice of Publication, mailed Jun. 21, 2007, 1 page.
U.S. Appl. No. 11/506,377: Non-Final Office Action, mailed Mar. 2, 2009, 13 pages.
U.S. Appl. No. 11/506,377: Response to Election/Restriction Filed, mailed Mar. 17, 2009, 2 pages.
U.S. Appl. No. 11/506,377: Notice Regarding Non-Compliant or Non-Responsive Amendment, mailed May 26, 2009, 2 pages.
U.S. Appl. No. 11/506,377: Examiner Interview Summary Record, mailed Jun. 29, 2009, 2 pages.
U.S. Appl. No. 11/506,377: Request for Reconsideration-After Non-Final Office Action, mailed Jul. 2, 2009, 21 pages.
U.S. Appl. No. 11/506,377: Final Office Action, mailed Sep. 29, 2009, 7 pages.
U.S. Appl. No. 11/506,377: Examiner Interview and Request for Continued Examination, mailed Nov. 13, 2009, 21 pages.
U.S. Appl. No. 11/506,377: Non-Final Office Action, filed Dec. 30, 2009, 6 pages.
U.S. Appl. No. 11/506,377: Request for Reconsideration-After Non-Final Office Action, mailed Feb. 18, 2010, 15 pages.
U.S. Appl. No. 11/506,377: Final Office Action, mailed May 24, 2010, 7 pages.
U.S. Appl. No. 11/506,377: Amendment After Final Office Action, mailed Aug. 24, 2010, 35 pages.
U.S. Appl. No. 11/506,377: Advisory Action, mailed Aug. 30, 2010, 3 pages.
U.S. Appl. No. 11/506,377: Notice of Appeal, mailed Sep. 7, 2010, 1 page.
U.S. Appl. No. 11/506,377: Appeal Brief Filed and Authorization for Extension of Time All Replies, mailed Jan. 7, 2011, 52 pages.
U.S. Appl. No. 11/506,377: Non-Final Office Action, mailed Feb. 17, 2011, 7 pages.
U.S. Appl. No. 11/506,377: Informal or Non-Responsive Amendment, mailed Apr. 18, 2011, 19 pages.
U.S. Appl. No. 11/506,377: Notice to Applicant Regarding Non-Compliant or Non-Responsive Amendment, mailed Apr. 19, 2011, 2 pages.
U.S. Appl. No. 11/506,377: Request for Reconsideration-After Non-Final Office Action, mailed May 18, 2011, 19 pages.
U.S. Appl. No. 11/413,758: Application as filed Apr. 27, 2006, 49 pages.
U.S. Appl. No. 11/413,758: Notice to File Missing Parts, mailed May 24, 2006, 2 pages.
U.S. Appl. No. 11/413,758: Notice to File Missing Parts Response, mailed Jul. 21, 2006, 18 pages.
U.S. Appl. No. 11/413,758: Notice of Informal Application, mailed Aug. 11, 2006, 1 page.
U.S. Appl. No. 11/413,758: Notice of Publication, mailed Nov. 1, 2007, 1 page.
U.S. Appl. No. 11/413,758: Requirement for Restriction/Election, mailed Jun. 13, 2008, 6 pages.
U.S. Appl. No. 11/413,758: Response to Election/Restriction Filed, mailed Aug. 13, 2008, 7 pages.
U.S. Appl. No. 11/413,758: Non-Final Office Action, mailed Dec. 2, 2008, 6 pages.
U.S. Appl. No. 11/413,758: Request for Reconsideration-After Non-Final Office Action, mailed Feb. 26, 2009, 4 pages.
U.S. Appl. No. 11/413,758: Final Office Action, mailed Jun. 24, 2009, 7 pages.
U.S. Appl. No. 11/413,758: Examiners Interview Summary, mailed Oct. 13, 2009, 4 pages.
U.S. Appl. No. 11/413,758: Final Office Action Response, mailed Oct. 21, 2009, 16 pages.
U.S. Appl. No. 11/413,758: Final Office Action, mailed Nov. 9, 2009, 10 pages.
U.S. Appl. No. 11/413,758: Examiner Interview Summary Record and Abandonment, mailed Jun. 8, 2010, 5 pages.

* cited by examiner

PROCESS TO MANUFACTURE FRAME USING RENEWABLE WOOD PRODUCT(S)

BACKGROUND

Various types of frames, such as for doors, windows, or the like for houses or other buildings, have been developed. A frame construction may utilize species of wood, such as fir, pine or poplar. Window or door frames are normally exposed to environmental factors, such as moisture, typically resulting in structural deterioration. A number of influences may include: microbial rot, insect infestation, water damage or other environmental factors. Deterioration of the wood frame is undesirable.

BRIEF DESCRIPTION OF THE DRAWINGS

Claimed subject matter is particularly pointed out and distinctly claimed in the concluding portion of the specification. However, both as to organization or method of operation, together with objects, features, or advantages thereof, it may be better understood by reference to the following detailed description if read with the accompanying drawings in which:

DETAILED DESCRIPTION

Figure 1:
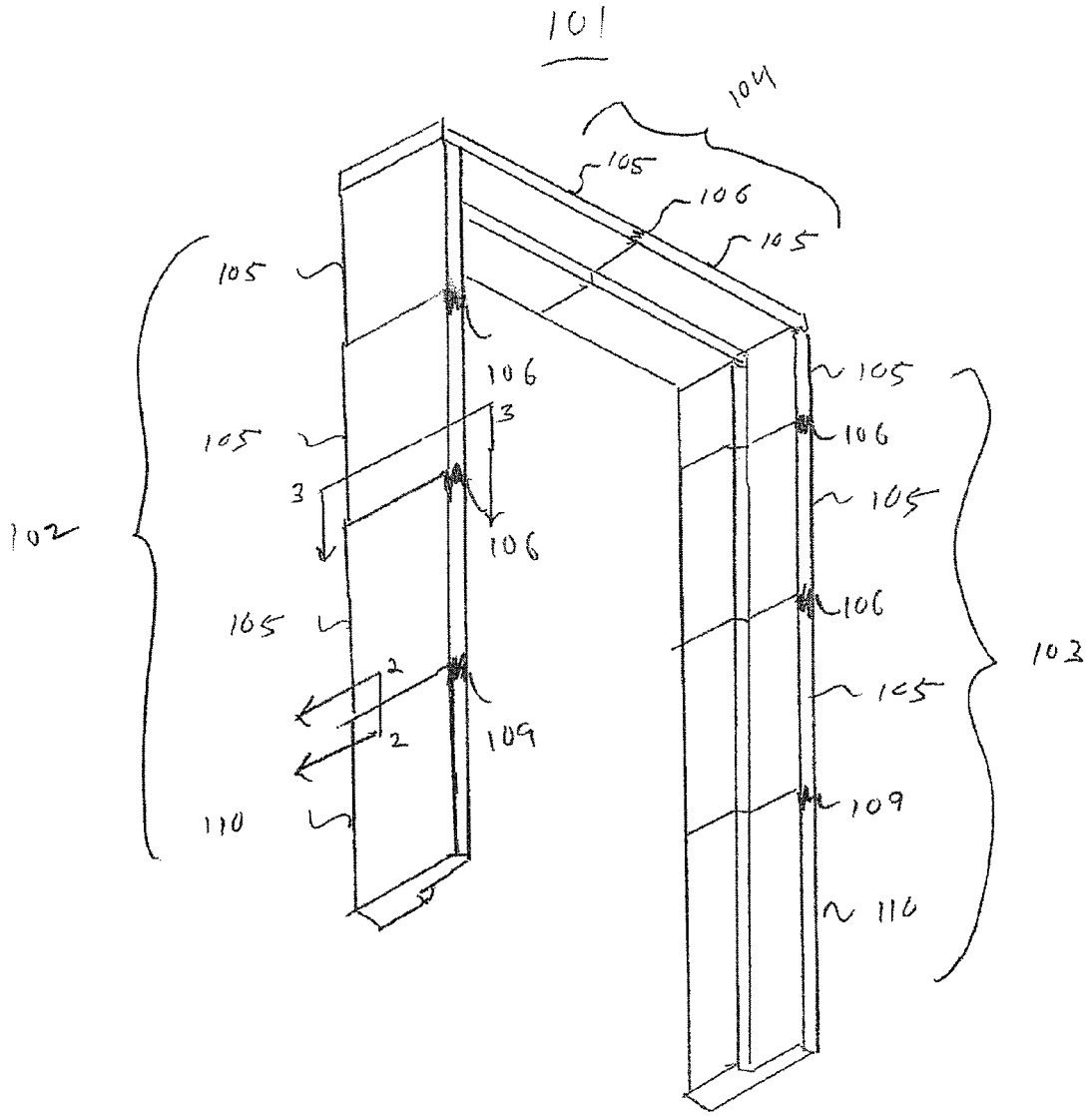
FIG. 1 is an isometric view of one embodiment of a frame.

In the following detailed description, numerous specific details are set forth to provide a thorough understanding of claimed subject matter. However, it will be understood by those skilled in the art that claimed subject matter may be practiced without these specific details. In other instances, methods, apparatuses or systems that would be known by one of ordinary skill have not been described in detail so as not to obscure claimed subject matter.

Reference throughout this specification to "one embodiment" or "an embodiment" may mean that a particular feature, structure, or characteristic described in connection with a particular embodiment may be included in at least one embodiment of claimed subject matter. Thus, appearances of the phrase "in one embodiment" or "an embodiment" in various places throughout this specification are not necessarily intended to refer to the same embodiment or to any one particular embodiment described. Furthermore, it is to be understood that particular features, structures, or characteristics described may be combined in various ways in one or more embodiments. In general, of course, these and other issues may vary with the particular context of usage. Therefore, the particular context of the description or the usage of these terms may provide helpful guidance regarding inferences to be drawn for that context.

Likewise, the terms, "and" and "or" as used herein may include a variety of meanings that also is expected to depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein may be used to describe any feature, structure, or characteristic in the singular or may be used to describe some combination of features, structures or characteristics. Though, it should be noted that this is merely an illustrative example and claimed subject matter is not limited to this example.

Various types of frames, such as for doors, windows, or the like for houses or other buildings, have been developed. A frame construction may utilize species of wood, such as fir, pine or poplar. However, as mentioned previously, environmental factors may result in deterioration or decay of these varieties of wood, which is typically undesirable.

In one potential embodiment, frame members may be made up of smaller pieces of wood finger jointed together. In general, frame members constructed of finger joined or jointed wood may be less costly compared to frame members constructed of a solid lumber of comparable dimensions. Therefore, typically, resulting assembled wood frames are less costly to manufacture. Frames may likewise be generally primed and painted so that finger joints are typically not visible and, therefore, do not typically detract from appearance of a finished product.

As mentioned, however, a frame, such as for a building or the like, e.g., a window or door frame, for example, is normally exposed to environmental factors. Thus, for example, moisture may result in wood deterioration or damage. A number of influences may include: microbial rot, insect infestation, water damage or other environmental factors.

Various frame constructions have been developed in an attempt to address decay or deterioration of a wood frame. For example, pressure-treated wood may be employed. However, in general, pressure-treated wood may not be suitable. Compounds utilized to treat wood may interfere with paint, for example. Likewise, extruded wood-based products have been employed. Examples are described in U.S. Pat. Nos. 5,873,209; 5,661,943; 6,122,882; and 6,446,410. However, for these approaches, dissimilarity of materials used in separate portions of a frame may result in potential issues regarding application of primer or paint. That is, paint or primer may not adhere or may provide a perceived difference in produce appearance as a result of dissimilarity of materials. USPTO Provisional application No. 60/887,256, filed on Jan. 30, 2007, entitled DOOR FRAME HAVING DURABLE WOOD PORTIONS discloses a door frame and other products having upper wood portions and lower portions of dissimilar wood varieties where the lower portions are made of various slow growing conifer species, such as Cedar and Cyprus. These species of trees are known for slow growth and longevity, including the *callitropsis nootkatensis*, which is known to grow for 2000 years, reaching a harvestable maturity at approximately 30-40 years. Use of wood products originating from slow growing tree species, such as Alaska Yellow Cedar a.k.a. *callitropsis nootkatensis*, or other species in the Cedar or Cyprus families, generally associated with old growth forests, may be costly or result in social or environmental concerns. Cedar and Cyprus trees tend to be desirable for construction, resulting historically in high-demand, overharvesting, higher costs, and environmental over consumption. Consequently, a product which relies upon wood products derived from these species may be subject to availability or cost fluctuation and potentially a host of other social or political factors as well. Additionally, identification of a product in the marketplace utilizing Cedar, Cyprus or other species associated with old growth forests, as an element of manufacture, may result in a negative public perception of the product itself.

One aspect of an embodiment in accordance with claimed subject matter comprises a plurality of frame members that are joined together to form a wood frame, such as for a door or window, for example. For example, FIG. 2 illustrates a portion of the embodiment of FIG. 1 in which frame members are finger jointed together. A wood frame, for example, may include an upper portion made of a wood species, such as fir, pine or other similar fast growing, inexpensive wood material. A lower portion of the wood frame may comprise a bamboo composite. An embodiment of a process or method for manufacture of blocks of bamboo composite is described in more detail below.

A bamboo composite may provide a variety of advantages. For example, it may provide resistance to wood deterioration or decay; however, paint or primer may adhere in a manner so that if joined with dissimilar woods, a difference in appearance may not be perceptible or barely so. Likewise, bamboo may be more available, less costly and not result in old growth forest environmental concerns in comparison with other wood varieties, such as Cypress or Cedar. Upper portions of a frame may be relatively inexpensive, thereby reducing overall cost of the frame. A bamboo composite in this embodiment may be used in the lower portions of the frame. A lower may be more heavily exposed to moisture or the like that may otherwise lead to decay of the wood frame. However, a bamboo composite may provide resistance to decay. In addition to door or window frames, other components that may have exposure to environmental factors, such as siding, exterior trim, or the like may also be constructed using a combination of fast growing, inexpensive wood material and a bamboo composite.

An embodiment of a wood frame is provided for purposes of illustration. For purposes of description herein, the terms "upper," "lower," "right," "left," "rear," "front," "vertical," "horizontal," and derivatives thereof shall relate to the embodiment shown in FIG. 1. However, it is to be understood that various alternative orientations are likewise possible. It is also to be understood that specific structures or processes shown in the attached drawings and described in this specification are simply provided as illustrative embodiments. Hence, specific dimensions or other physical characteristics relating to the embodiments disclosed herein are not to be considered as limiting.

Figure 2:
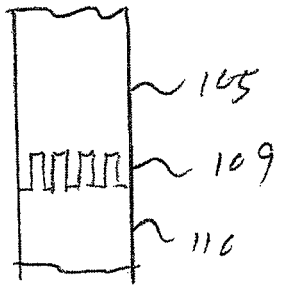
FIG. 2 is a cross-sectional view of a portion of the frame of FIG. 1, taken along the line 2-2.

A wood frame 101 is illustrated in FIG. 1. Wood frame 101 includes upright side frame members 102 and 103, and an upper frame member 104 extending between and interconnecting side frame members 102 and 103. Side frame members 102 and 103, and upper frame member 104, include a plurality of individual upper pieces of wood that are connected together at finger joints, such as 106. Upper pieces of wood 105 may be made of a wood material, such as fir or the like, used for constructing frames or other wood structures of houses, for example. Although wood species of this type, e.g. fir, pine or poplar, are relatively low cost and provide structural strength, these varieties or species of wood generally provides less weather or decay resistance than may be desirable for some situations.

In addition to upper pieces of wood 105, upright side frames 102 and 103 may also include a bamboo composite 110 connected to an adjacent upper piece of wood 105 by a finger joint 109, again, as illustrated in FIG. 2, for example. Lower pieces of wood 110 may comprise bamboo composite, which may be resistant to decay, rot, insect damage or other degradation due to moisture or other weather or environmental conditions. Of course, virtually any suitable joint configuration may be utilized to interconnect upper pieces of wood 105 to lower pieces of wood 110. For example, dovetails, dowels, mechanical connectors, or virtually any other connection arrangement may also be utilized.

For an embodiment, lower wood pieces 110 may comprise a bamboo composite. Details regarding a process or method of manufacture of an embodiment of a bamboo composite are now provided, referring to FIG. 4. It is of course appreciated that any shape or size of wood frame element may be manufactured. Lower wood pieces 110 are provided merely for illustration purposes. Likewise, claimed subject matter is not limited in scope to the method or process embodiment provided below. For example, other process operations in addition to the process operations below or as alternatives to particular process operations below may be employed. Likewise, in other embodiments, variations in the order of process operations described may also be possible.

Figure 4:
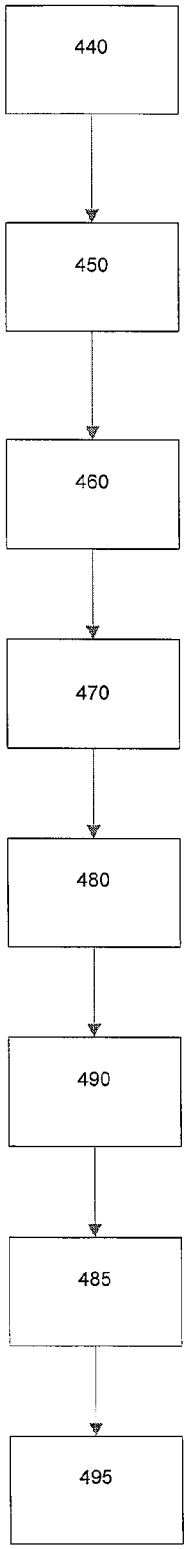
FIG. 4 is a flow chart of an embodiment of a method of constructing or manufacturing a frame.

FIG. 4 is a flow chart of one embodiment of a method or process for making a bamboo composite, such as in blocks, for use in a wood frame. It is noted that quantities provided below are provided for purposes of illustration and are not meant to limit the scope of claimed subject matter. For example, initially, at box 440, raw bamboo logs may be cut to a desired standard length, such as a length of 30 inches for example. At box 450, standard length bamboo logs may be split lengthwise into strips or stickers of a particular width, such as a width of 1.5 inches, for example. It is noted that adjustment for bamboo log diameter to achieve a desired width may be appropriate. At box, 460, bamboo stickers may be planed, such as by a planning machine, so that the stickers achieve consistent proportions e.g., rectangular. At box 470, bamboo stickers may be steamed, such as through placement in an industrial steam oven capable of maintaining a pressure of around 8 kg/cm3 temperature of approximately 100 degrees for about two hours. This steaming process may reduce sugar or other organic contaminants through carbonization. At box 480, carbonated stickers may be kiln dried in the range of approximately 70-80 degrees for about 170 hours or until moisture content is reduced to around 7-10%. At box 490, the stickers may be acclimatized for approximately 110 hours prior to further processing.

At box 485, bamboo stickers may be assembled or composed into bamboo composite blocks. For example, a glue or similar material may be employed on the surface of the stickers. At box 495, bamboo composite blocks may be hot pressed at a temperature of around 100 degrees, a side pressure of about 10 kgs/cm2, and top pressure of about 20 kgs/cm2, for a period of approximately 1 minute per millimeter in thickness.

As discussed above, the upper pieces of wood 105 may comprise a wood other than a bamboo composite. For example, fir or other woods, such as radiator pine, eastern white pine, ponderosa pine, elliotis pine, or other pines, poplars, or other fast growth species may be employed. It will be understood that suitable examples of wood for the upper pieces of wood 105 are not limited to these species. These examples of wood species or varieties are intended to be illustrative rather than exhaustive. Likewise, the upper pieces may also comprise a manufactured or composite wood derived from a combination of wood materials processed to form a rectangular wood block suitable for milling and joining. For example, upper frame members may be assembled from smaller pieces of wood materials in accordance with, for example, a process of manufacturing described by U.S. patent application Ser. No. 11/506,377, titled "Composite Frame for an Opening," filed on Aug. 18, 2006, by D. Todd Lemons, and assigned to the assignee of the currently claimed subject matter. Of course, it is appreciated that claimed subject matter is not limited in scope to employing an approach described in the foregoing patent application. Rather, it is provided here for illustrative purposes.

Depending at least in part upon the particular frame, lower wood pieces 110 may vary in height. For example, without limitation, a height of about 4 inches to about 10 inches may be employed, but may be as large as approximately 24 inches or as small as approximately 1 inch may be employed. Likewise, if desired, a plurality of pockets (not shown) may be formed to accommodate door hinges, for example.

Figure 3:
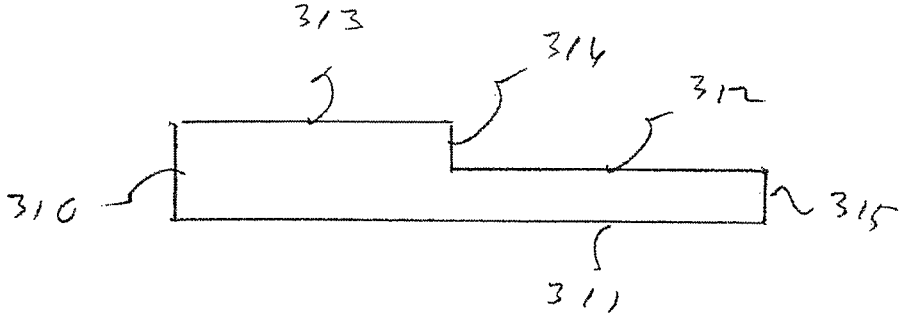
FIG. 3 is a cross-sectional view of the frame of FIG. 1, taken along the line 3-3.

With further reference to FIG. 3, frame elements 105 and 110 may generally have a flat outer surface 311, and inner surfaces 312 and 313, with a transverse surface 314 extending between inner surfaces 312 and 313 to form a stop. End surfaces 315 and 316 extend between outer surface 311, and inner surfaces 312 and 313, respectively. In general, upper frame member 104 may have a cross-sectional shape that is substantially the same or similar to the cross-sectional shape of side frame members 102 and 103. However, it will be understood that the cross-sectional shape of frame elements 105 and 110 may vary depending upon the particular type of frame or other component that is being fabricated. Likewise, frame members need not have identical cross-sectional shapes. For example, a frame member of a garage door frame may generally have a cross-sectional shape configured to accommodate a garage door, and window frames may a cross-sectional shape to accommodate a particular type of window.

The following describes one embodiment of a process for joining upper and lower frame elements. As discussed previously, finger joints are cut into an upper frame element to match finger joints cut into a lower frame element, in this embodiment, a bamboo composite. The frame elements may be joined by a thermosetting polymer, such as, for example, an epoxy. A composite comprising joined upper and lower elements results which may be milled to specification. Surface imperfections may be filled and sealed. As described in more detail below, a variety of coatings and sealants may be applied, typically to a frame, such as 101.

Surfaces 311-316 of frame members 102, 103, and 104 may be treated on all exposed surfaces using, in at least one embodiment, a process that includes a: sealant coating, a bridge coat, a cellcoat, and a coating of paint primer. A sealant coating may prepare the wood by penetrating on a cellular level to reduce water penetration. A bridge coating may be applied to create a surface to which a cellcoat may bond. A cellcoat may bond with a bridge coat to create a durable surface resistant to intrusion by water or insects. Likewise, an application of primer paint may prepare frame members 102, 103, and 104 for painting to provide a finished appearance In general, a frame 101 may be painted after it is installed in a building, but it may alternately be pre-painted prior to installation.

Upper pieces of wood 105 and lower pieces of wood 110 typically are intended to exhibit similar properties with respect to absorption or adherence of primer and paint, such that a durable, substantially uniform coating over a frame results. This provides a substantially uniform appearance without special treatments. Likewise, frame elements or pieces 105 and 110 may tend to retain a similar appearance over time.

An advantage of an embodiment of a process as previously described, for example, is ready availability of materials. Upper elements may be derived from fir, pine or other fast growing and renewable forest crops which may be replanted, grown, and harvested for a similar purpose in as few as 10-20 years. Similarly, bamboo typically has a 6 year harvest cycle. A combination of these renewable wood products may result in a finished material appealing to consumers interested in durable, cost-efficient, and environmentally sustainable products that reduce demand to harvest old growth forests. In the context of this application, the term "renewable product" or "renewable wood product" refers to a wood product made from wood having a harvest cycle such that the anticipated life of the product is at least as long or greater than the harvest cycle. Under normal conditions, the projected life of a frame may be estimate to be at 25-40 years under normal conditions, whereas the wood may regenerate in as few as 10 years. Therefore, for the frame embodiment described, for example, the resulting product comprises a renewable wood product.

A frame or other component manufactured in accordance with claimed subject matter may be cost-effective and weather resistant. Use of a bamboo composite may address use of dissimilar frame materials. A frame or other components manufactured in accordance with claimed subject matter may be highly durable, cost-effective and renewable.

In the preceding description, various aspects of claimed subject matter have been described. For purposes of explanation, systems or configurations were set forth to provide an understanding of claimed subject matter. However, claimed subject matter may be practiced without those specific details. In other instances, well-known features were omitted or simplified so as not to obscure claimed subject matter. While certain features have been illustrated or described herein, many modifications, substitutions, changes or equivalents will now occur to those skilled in the art. It is, therefore, to be understood that the appended claims are intended to cover all such modifications or changes as fall within the true spirit of claimed subject matter.

The invention claimed is:

1. A method of processing bamboo to produce bamboo composite blocks for use in a wood frame comprising:

forming rectangular bamboo stickers, wherein a rectangular bamboo sticker comprises consistent dimensions as to at least one other of the rectangular bamboo stickers;

steaming the rectangular bamboo stickers;

kiln drying the rectangular bamboo stickers;

acclimatizing the rectangular bamboo stickers;

assembling the rectangular bamboo stickers to form bamboo composite blocks; and hot pressing the bamboo composite blocks.

2. The method of claim 1, wherein said steaming comprises a carbonizing treatment.

3. The method of claim 1, wherein said forming rectangular bamboo stickers of consistent dimensions comprises:

cutting raw bamboo logs, a raw bamboo log having a length consistent with at least one other raw bamboo log;

splitting the raw bamboo logs in accordance with log diameter to form bamboo stickers, a bamboo sticker having a width consistent with at least one other bamboo sticker; and planing the bamboo stickers to form bamboo pieces, a first bamboo having consistent rectangular proportions consistent with the rectangular proportions of at least one other bamboo piece.

4. The method of claim 1, and further comprising:

cutting finger joints in to the bamboo composite blocks.

5. The method of claim 4, and further comprising:

joining finger joints in the bamboo composite blocks with corresponding finger joints in non-bamboo wood blocks using a thermosetting polymer; and processing surface imperfections in the joined wood blocks.

6. The method of claim 5, wherein the thermosetting polymer comprises epoxy.

7. The method of claim 4, and further comprising:

joining other non-bamboo wood blocks to form an at least partial frame structure.

8. The method of claim 7, and further comprising: coating exposed surfaces of the at least partial frame structure with the following coatings: sealant coating, a bridge coat, a cellcoat, and a coating of paint primer.

9. The method of claim 1, wherein said steaming the rectangular bamboo stickers comprises steaming the rectangular bamboo stickers at a pressure of around 8 kg/cm$^3$ temperature of approximately 100 degrees for about two hours; and wherein said kiln drying the rectangular bamboo stickers comprises kiln drying the rectangular bamboo stickers in the range of approximately 70-80 degrees for about 170 hours or until moisture content is reduced to around 7-10%.

10. The method of claim 1, wherein said hot pressing the bamboo composite blocks comprises hot pressing the bamboo composite blocks at a temperature of around 100 degrees, a side pressure of about 10 kgs/cm2, and top pressure of about 20 kgs/cm2, for a period of approximately 1 minute per millimeter in thickness.

* * * * *